US005148888A

United States Patent [19]

Bank et al.

[11] Patent Number: 5,148,888

[45] Date of Patent: Sep. 22, 1992

[54] RIBBON TRANSDUCERS

[76] Inventors: Graham Bank, 15 Mayfield Lane, Martlesham, Ipswich, Suffolk; Harold C. Pinfold, deceased, late of Elstree, both of England; by Laurence P. Ross, executor, 35, Barham Avenue, Elstree, Herts., United Kingdom, executor of said Carl Pinfold, deceased

[21] Appl. No.: 540,963

[22] Filed: Jun. 20, 1990

[30] Foreign Application Priority Data

Jun. 21, 1989 [GB] United Kingdom ..... 8914283

[51] Int. Cl.[5] ..... G10K 13/00

[52] U.S. Cl. ..... 181/171; 181/172

[58] Field of Search ..... 181/171, 172; 381/188, 381/193, 197, 203, 205, 176

[56] References Cited

U.S. PATENT DOCUMENTS

| | | | |
|---|---|---|---|
| 4,239,943 | 12/1980 | Czerwinski | 381/197 |
| 4,317,966 | 3/1982 | Lister . | |
| 4,461,932 | 7/1984 | Oyaba | 181/171 |
| 4,580,014 | 4/1986 | Hobrough . | |

FOREIGN PATENT DOCUMENTS 793261 of 1958 United Kingdom .

*Primary Examiner*—L. T. Hix
*Assistant Examiner*—Khanh Dang
*Attorney, Agent, or Firm*—Seidel, Gonda, Lavorgna & Monaco

[57] ABSTRACT

A ribbon transducer has its ribbon which is held at each end made capable of lateral movement for adjustment puroses by providing a plurality of traverse cross-suspension elements to which the ribbon is secured, with each of these cross-suspension elements being capable of transverse displacement, for example by rotation of mounting pillars.

6 Claims, 1 Drawing Sheet

RIBBON TRANSDUCERS

This invention relates to ribbon transducers and is particularly concerned with the mounting of the ribbon itself, particularly in transducers for use in loudspeakers and microphones.

In order to achieve satisfactory operation of a ribbon transducer it is necessary that the ribbon itself should be centered so that its longitudinal axis lies correctly in relation to the other components. Various methods have been proposed heretofore for centering a ribbon. One method involves the use of shaped magnets for this purpose. In another alternative arrangement the ribbon is attached to stretcher elements at the sides and is held in tension by a spring mechanism. Such arrangements are complicated and not capable of easy adjustment.

It is an object of the present invention to provide a means for centering a ribbon of a ribbon transducer in a manner which is simple and capable of easy adjustment.

In accordance with the present invention this is achieved by providing a plurality of cross-suspension elements transversely to the longitudinal axis of the ribbon and to which the ribbon is secured, with each of these cross-suspension elements being capable of displacement in the direction at right angles to the longitudinal axis of the ribbon, to produce consequential lateral movement of the ribbon.

Preferably, the cross-suspension elements comprise strips or bands of material affixed by adhesive for example to one face of the ribbon and secured at each end to support means. The support means can be adjusted to effect movement of the cross-suspension elements at right-angles to the longitudinal axis of the ribbon.

Figure 1:
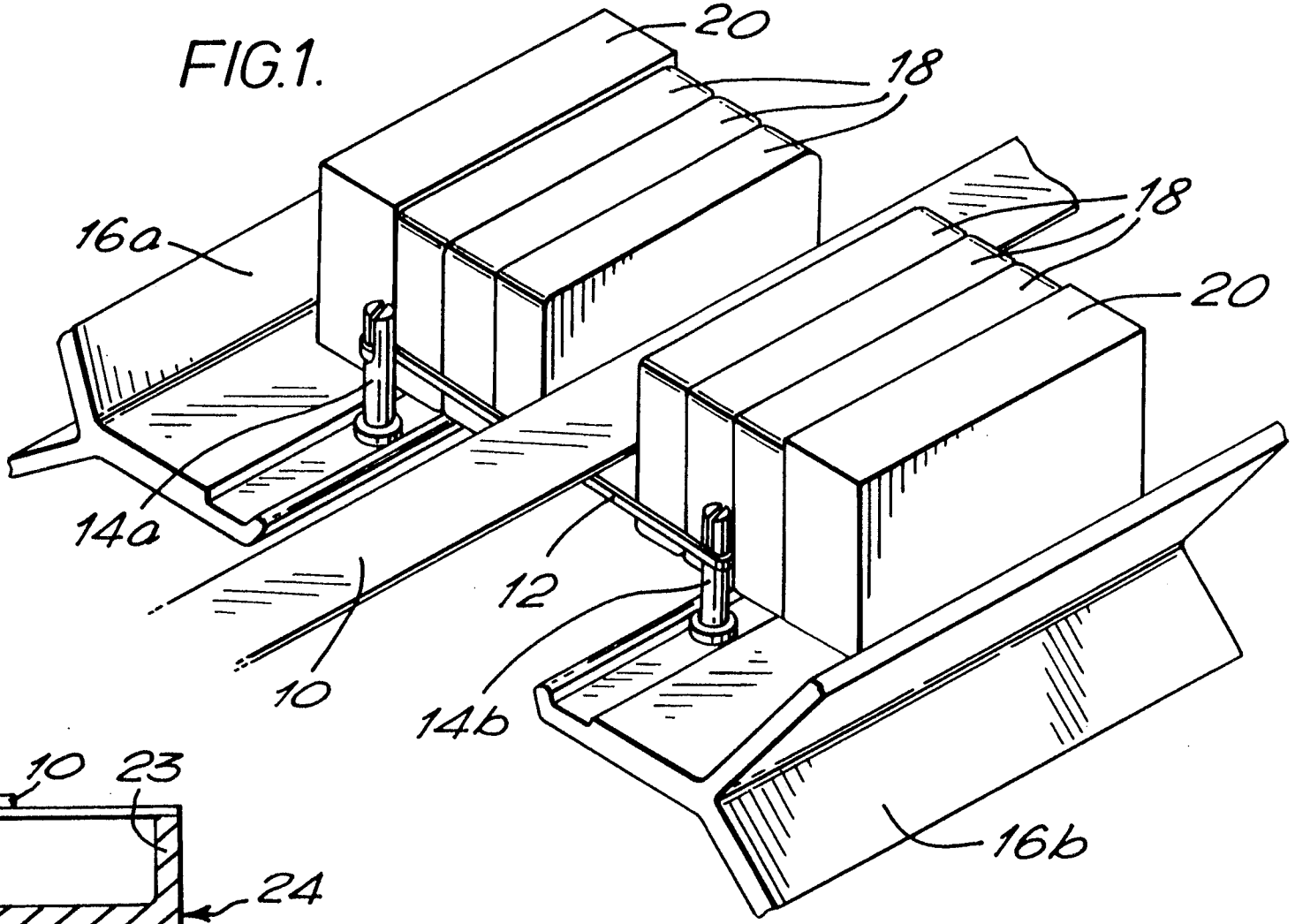
Figure 2:
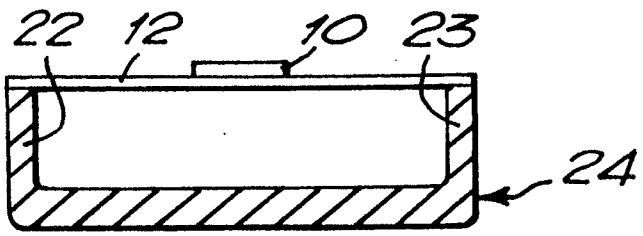

In order that the invention may be more fully understood, preferred embodiments of cross-suspension mounting for a ribbon of a ribbon transducer will now be described by way of example and with reference to the accompanying drawings, in which:

FIG. 1 is an isometric view of a first embodiment of mounting arrangement; and FIG. 2 is a schematic diagram of a second mounting arrangement.

Referring to the drawings, there is shown in FIG. 1 a ribbon foil 10 which constitutes part of a ribbon transducer, for example for a loudspeaker. Beneath the underside of the ribbon foil 10 lies a cross-suspension element 12. This is in the form of a band or strip which is affixed, for example by adhesive, to the underside of the ribbon foil. The ends of the cross-suspension element 12 are secured in suspension pillars 14*a* and 14*b* positioned one on each side of the ribbon foil so that the element 12 lies at right-angles to the longitudinal axis of the foil. Each of the suspension pillars 14*a*, 14*b* is provided with a slot in the end thereof, so that the pillars can be rotated, for example with a screwdriver. The suspension pillars 14*a*, 14*b* are mounted on rear and front extrusion plates 16*a* and 16*b* respectively so that they can be rotated relative to the support plates and will hold their adjusted positions. The front and rear extrusion plates 16*a*, 16*b* also serve as support plates for magnets 18 which are held in place by backing plates 20.

In use, in order to centre the ribbon foil 10, it is simply necessary to displace the cross-suspension element 12 by rotation of the suspension pillars until the ribbon foil is accurately centered. A maximum displacement of plus or minus 1 millimeter is generally sufficient.

It will be appreciated that the ribbon foil 10 is provided with a plurality of cross-suspension elements 12 at intervals along its length so that the foil can be accurately centered throughout its length.

Alternative methods of mounting the cross-suspension elements 12 may be devised within the scope of the present invention. For example, as shown in FIG. 2, instead of providing a suspension pillar on each side of the ribbon foil, the cross-suspension element 12 could be mounted between the two limbs 22, 23 of a generally U-shaped support member 24, for example a plastics moulding. Adjustment means would then be provided for moving the cross-suspension element 12 relative to the U-shaped support 24. Alternatively, the U-shaped support 24 could be movable bodily, with the cross-suspension element 12, to effect the required adjustment. Various other alternative methods of mounting and support will be apparent to those skilled in the art.

We claim:

1. A ribbon-type transducer comprising an elongate, electrically conductive, vibratable ribbon having two oppositely disposed ends, first and second suspension means at the respective ends of the ribbon and defining a longitudinal axis of the ribbon therebetween, a plurality of cross-suspension elements transversely of the longitudinal axis of the ribbon and to which the ribbon is secured, each said cross-suspension element being capable of displacement at right angles to the longitudinal axis of the ribbon, and means to effect said displacement of each said cross-suspension element thereby to produce lateral movement of the ribbon.

2. A ribbon transducer according to claim 1, in which the cross-suspension elements comprise strips or bands of material which traverse the ribbon and are fixed to the ribbon and are secured at each end to support means.

3. A ribbon transducer according to claim 2, in which the strips or bands are fixed to the ribbon by adhesive.

4. A ribbon transducer according to claim 2, in which said support means can be adjusted to effect movement of the cross-suspension elements at right-angles to the longitudinal axis of the ribbon.

5. A ribbon transducer according to claim 2, in which the support means comprises adjustably rotatable posts positioned on each side of the ribbon.

6. A ribbon transducer according to claim 1, in which each cross-suspension element is carried by a U-shaped support member which bridges the ribbon.

* * * * *